US006272900B1

(12) United States Patent
Kobel

(10) Patent No.: US 6,272,900 B1
(45) Date of Patent: Aug. 14, 2001

(54) EXTENSION RAM TIP

(76) Inventor: Matthew Kobel, 81-30 Dongan Ave., Elmhurst, NY (US) 11373-3731

( * ) Notice: Subject to any disclaimer, the term of this patent is extended or adjusted under 35 U.S.C. 154(b) by 0 days.

(21) Appl. No.: 09/296,025

(22) Filed: Apr. 21, 1999

(51) Int. Cl.[7] ..... B21D 1/12
(52) U.S. Cl. ..... 72/392; 72/705; 254/133 R
(58) Field of Search ..... 72/392, 705, 477; 254/133 R

(56) References Cited

U.S. PATENT DOCUMENTS

| | | | | |
|---|---|---|---|---|
| 2,010,713 | | 8/1935 | Countryman . | |
| 2,269,835 | | 1/1942 | Wallace et al. . | |
| 2,767,605 | | 10/1956 | Schmid . | |
| 3,567,182 | * | 3/1971 | Steele | 254/133 R |
| 4,088,002 | * | 5/1978 | Andrew | 72/705 |
| 4,167,108 | | 9/1979 | Jarman et al. . | |
| 4,273,311 | * | 6/1981 | Rio | 254/133 R |
| 4,522,054 | | 6/1985 | Wilson et al. . | |
| 4,531,289 | | 7/1985 | Brick . | |
| 4,762,304 | | 8/1988 | Hill . | |
| 4,930,337 | | 6/1990 | Schaap . | |
| 4,973,028 | | 11/1990 | Linster . | |
| 5,105,543 | | 4/1992 | Maarschalk et al. . | |
| 5,243,761 | | 9/1993 | Sullivan et al. . | |
| 5,267,462 | | 12/1993 | Pijanowski . | |
| 5,379,849 | | 1/1995 | Russell . | |
| 5,810,333 | * | 9/1998 | Hickerson et al. | 254/133 R |
| 5,855,358 | * | 1/1999 | Witter | 254/25 |
| 5,904,340 | * | 5/1999 | Allamon | 254/133 R |

OTHER PUBLICATIONS

Hurst Catalog, "Hurst Jaws of Life," Bull No. 564, Jun. 1993, pp. 1, 7 and 14.
Lukas Catalog, "Lukas Rescue Tools," 1997, pp. 1, 5 and 10.
Paratech Brochure, date unknown.
Amkus Catalog, "Amkus Rescue Systems," 1992, pp. 1, 10 and 11.
John P. O'Connell, "Collapse Search and Rescue Operations: . . . ," Fire Engineering, Mar. 9, 1994, ed.

* cited by examiner

*Primary Examiner*—Lowell A. Larson
(74) *Attorney, Agent, or Firm*—Jordan and Hamburg LLP

(57) ABSTRACT

A ram tip minimizes lateral slippage of an extension ram, while permitting reception of a range of differently sized work structures without contributing significantly to the axial length of the ram. The ram tip includes a base portion presenting a primary support surface oriented substantially perpendicular to an extension axis of the ram and facing outwardly of the ram. The support surface includes texturing providing frictional resistance against lateral movement of the work structure in contact therewith. Structure providing secondary safeguard against lateral disengagement of the ram tip from the work structure during operation includes bilaterally disposed support walls which include primary lateral support portions extending from the base codirectionally with the extension axis of the ram. In a preferred embodiment, the support walls include an internally stepped region presenting a pair of secondary support surfaces parallel with the primary support surface, and a pair of secondary lateral support portions extending codirectionally with the ram extension axis and separated a greater distance from one another than the primary lateral support portions. Such configuration permits fitted reception of work structure of smaller width between the primary lateral support portions for support against the primary support surface, and fitted reception of structure of greater width between the secondary lateral support portions for support on either side thereof against the secondary support surfaces.

23 Claims, 4 Drawing Sheets

EXTENSION RAM TIP

BACKGROUND OF THE INVENTION

The present invention relates to a rescue device, and, more particularly, to a tip mountable to a hydraulically operated ram used for extricating trapped occupants from damaged vehicles and the like.

Hydraulically operated rescue tools are well known, and are widely used by fire, police, rescue and military personnel for effecting extrications in various emergency situations. Tools of this type are available in a variety of designs, each functioning in a manner suited to meet a particular demand. Such hydraulic tools include, for example, spreaders, cutters and extension rams, which together provide the user with a significant degree of functional versatility.

Of these tools, rams are generally adapted to situations requiring a pushing, pulling or shoring operation. The hydraulically operated ram comprises a piston/cylinder combination which permits forceful extension of an overall length thereof by introduction of a hydraulic fluid from a pressurized source. During use directed to a pushing operation, the ram is interposed in the space between opposed structures to be separated, with tips located at axial ends of the ram in respective contact therewith. When hydraulically induced displacement force is applied, which may be as high as 15,000 lbs., axial extension of the ram widens the distance between the opposed structures contacted by the ram tips, which yield to the applied force. Tips standard to most rams for engaging the structure to be worked upon generally consist of a block-like structure presenting a planar contact surface arranged perpendicular to the extension axis of the ram textured with a series of raised serrations, designed to bite into the structural material brought into contact therewith, and provided to discourage slippage during application of pressure.

The overall dimensions of the rescue device can influence effective operation of the tool, since the distance between the opposed structures to be moved apart varies with the particular application. Furthermore, many of the situations encountered by a rescue worker involve confined areas, and therefore overall length of the ram must often be minimized to permit its accommodation in the work space. In addition, the structures to be moved apart are often of different widths and cross-sectional shapes, and therefore the tip structure provided at the ends of the rams must be properly configured to correspond to the structure with which they are brought into contact in order to assure positive engagement therebetween for safe and effective operation when hydraulically induced force is applied. For example, when extricating an accident victim from a damaged vehicle, it may be necessary to move apart door jams or window frames. Additionally, such situations may further require upward displacement of a steering column damaged in a collision in order to free a trapped driver who is perhaps injured and in need of immediate medical care. The respective cross-sectional size and shape of the door jam, window frame and steering wheel, are quite different from one another, and their spacing from opposed structure may demand a compact ram for one or more of the applications.

In an attempt to meet these requirements and guidelines, extension rams have heretofore been commercially available in a variety of different lengths. The rescue or emergency worker equipped with several rams can therefore select the one best suited to the task at hand. Adapter tips are also available which are receivable at opposed ends of the ram, variously configured to supplement standard tips when mounted thereto in overlying engagement.

Selection and substitution of the variously sized rams and tips during an extrication provides a reasonable degree of versatility, and does not seriously jeopardize the success of the freeing operation in situations where the worker is not operating under a significant time constraint. Often, however, use of such emergency equipment is directed to applications in which the person to be freed is injured, sometimes severely, and the time required to complete the rescue operation is therefore an important consideration. In addition, a dangerous condition may be present, such as an imminent fire or explosion hazard, and the time required for extrication must be minimized for safety of the victim and rescuer alike. Such time sensitive scenarios do not always afford the luxury of engaging in the potentially time consuming task of multiple ram substitutions and/or removal and remounting of adapter tips.

Furthermore, although variously designed adapter tips are currently available in a variety of configurations, the designs do not adequately insure against accidental disengagement from the work structure during application of pressure, creating a potential hazard to both the worker and occupant.

A ram design which would minimize the required number of tool substitutions during an extrication operation, and in which the likelihood of accidental disengagement from a work structure were reduced, would therefore be highly desirable.

Accordingly, it is an object of the invention to provide a tip mountable to an extension ram which overcomes the drawbacks of the prior art.

It is a further object of the invention to provide a ram tip which permits versatile engagement with work structures presenting various sizes and cross-sectional shapes in a manner inhibiting accidental disengagement therefrom during application of extension force.

SUMMARY OF THE INVENTION

In accordance with these and other objects of the invention, there is provided a tip for mounted use with an extension ram which minimizes lateral slippage of an extension ram, while permitting reception of a range of differently sized work structures without contributing significantly to the axial length of the ram.

Briefly stated, the ram tip includes a base portion presenting a primary support surface oriented substantially perpendicular to an extension axis of the ram and facing outwardly of the ram. The support surface includes texturing providing frictional resistance against lateral movement of the work structure in contact therewith. Structure providing secondary safeguard against lateral disengagement of the ram tip from the work structure during operation includes bilaterally disposed support walls which include primary lateral support portions extending from the base arranged codirectionally with the extension axis of the ram.

In an embodiment in accordance with the invention, alternative to providing the ram tip structure in accordance with the various embodiments of the invention, a ram tip is provided in the form of an adapter receivable in mounted engagement on a ram equipped with a standard ram tip. Mounting is accomplished by suitable structure cooperative with means provided on the particular ram.

In accordance with an advantageous further embodiment of the invention, there is provided a ram tip in which the support walls include an internally stepped region presenting a pair of secondary support surfaces parallel with the primary support surface, and a pair of secondary lateral support portions extending codirectionally with the ram extension axis and separated a greater distance from one another than the primary lateral support portions. Such configuration permits fitted reception of work structure of smaller width between the primary lateral support portions for support against the primary support surface, and fitted reception of structure of greater width between the secondary lateral support portions for support on either side thereof against the secondary support surfaces.

In an alternative embodiment in accordance with the invention, deformation of a ram tip provided as a removable adapter is reduced by orienting mounting flanges perpendicular to the lateral support portions. Further reduction in angular deformation is accomplished by providing reinforcement structure in a position along at least a partial length of an intersecting locus of inwardly facing sides of the primary lateral support portions and the support surface on the base.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
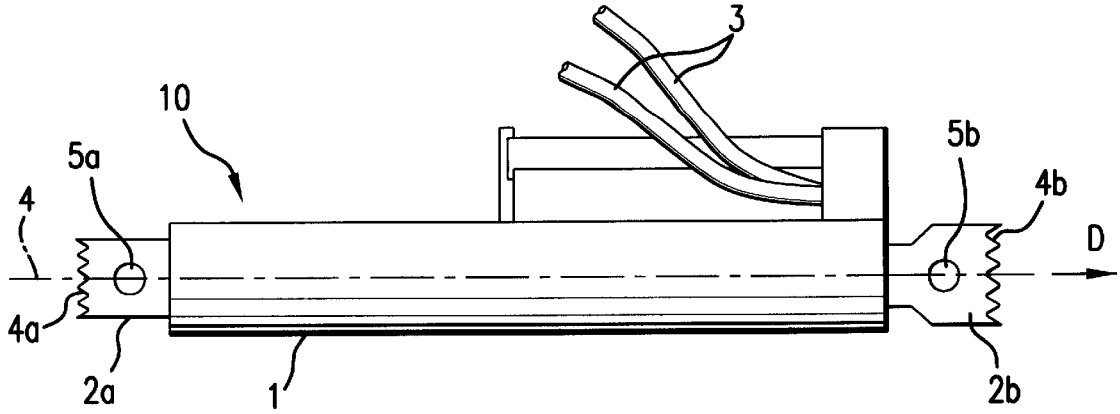
FIG.1 PRIOR ART
FIG. 1 is a simplified schematic side view of a prior art extension rain shown unextended.

Referring to the figures, and in particular FIG. 1, a typical prior art ram is depicted, generally designated 10. Ram 10 includes a body 1 which internally houses a cylinder/piston combination (not shown), the details of which are well known in the art, and for which farther explanation is therefore omitted as redundant. A standard tip 2*a* is fixedly carried at one end of body 1, and another standard tip 2*b* is provided on structure moveable with actuation of the piston in an axial direction of ram 10, as indicated by the arrow D. Ram 10 is actuated by introduction of a hydraulic operating fluid from a pressurized supply (not shown) via hoses 3. Standard tips 2*a* and 2*b* have a block-like structural configuration presenting a planar contact surface 4*a* arranged perpendicular to extension axis A of ram 10 textured with a series of raised serrations, designed to bite into the structural material brought into contact therewith, and provided to discourage slippage during application of extension force.

Depending on the particular application, tips having specialized structure more closely suited to the task than the standard tips 2*a* and 2*b* are commercially available in a number of different shapes. For example, an adapter tip of conical shape is shown for example in FIG. 2, generally designated 20. Conical adapter tip 20 includes a conically shaped forward end portion 20*a* and a pair of flanges 20*b* which provide convenient means for fixed attachment of conical adapter tip 20 to standard tip 2*b*. Flanges 20*b* overlap opposed sides of standard tip 2*b*, and each includes a hole 20*c* aligned along an axis common to both arranged crosswise flanges 20*b*. A locking pin 21 is received through holes 20*c* which are aligned with another hole 5*a* formed in standard tips 2*b* (and 2*a* as shown in FIG. 1). In this mounted position, an inner side 20*d* of conical adapter tip 20 supportingly rests against planar contact surface 4*a* of standard tip 2*b*, preventing sheer stress on locking pin 21 when axial extension force is applied by ram 10.

Figure 3:
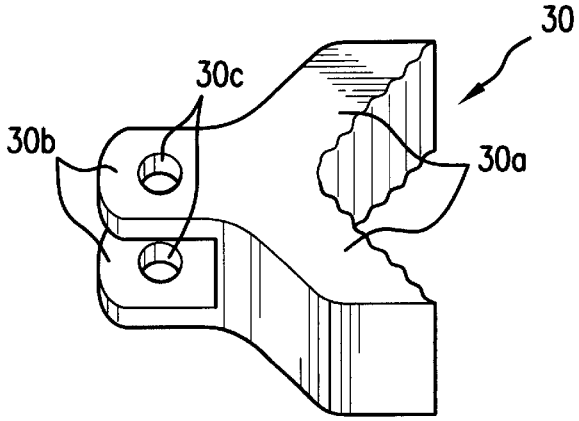
FIG.3 PRIOR ART
FIG. 3 is a perspective view of a prior art V-block adapter tip.

Turning now to FIG. 3, another prior art adapter tip is shown, generally designated 30. V-block adapter tip 30 includes a pair of flanges 30*b* configured analogously with flanges 20*b* of conical adapter tip 20, and each also having a pair of holes 30*c* to permit mounting as previously described. A front portion 30*a* of V-block adapter tip 30 presents a v-shaped opening for accommodating therein a variety of frames and other work structures of varying width. Although moderately effective for many applications, this design does not adequately safeguard against accidental, and potentially dangerous, lateral disengagement of the tip from the structure being worked upon during application of extension force, and, as a consequence of the v-shaped profile, also sacrifices compactness of the overall ram length in order to achieve accommodation of structure presenting a range of widths which may preclude its use in confined areas, such as under steering wheels.

The invention therefore provides a tip having a configuration in accordance with various embodiments which minimizes lateral slippage of an extension ram relative to a work structure forcibly acted upon thereby, while permitting reception of a range of differently sized frames, pillars and other work structures without contributing significantly to the axial length of the ram. Common to each embodiment is structure providing secondary safeguard against lateral disengagement of the ram tip from the work structure against which it forcibly impinges.

Figure 4:
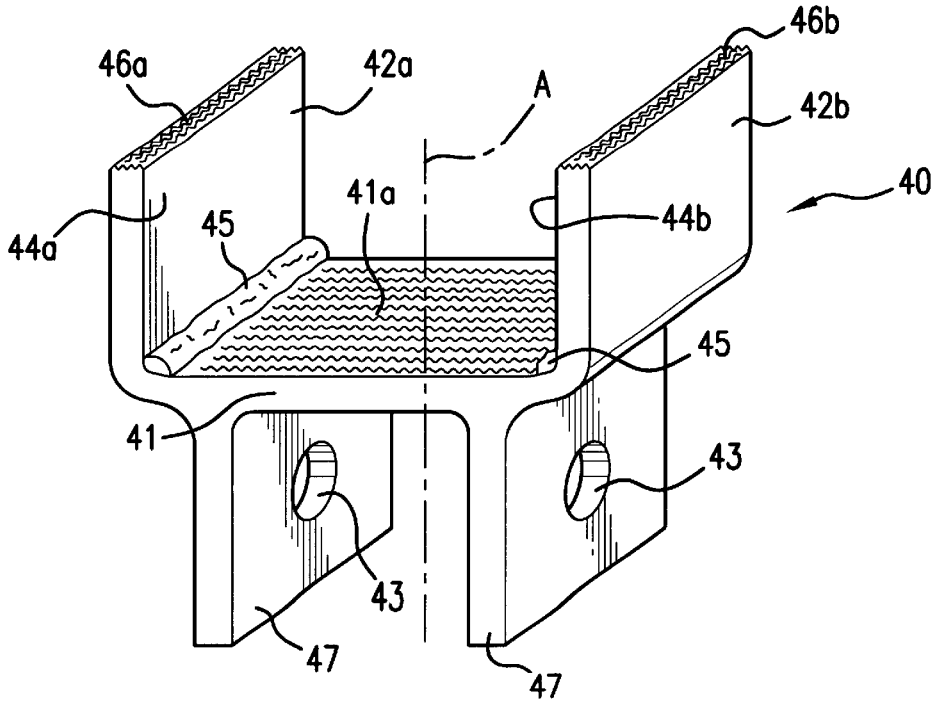
FIG. 4 is a perspective view of an embodiment of an adapter tip in accordance with the invention.

Referring now to FIG. 4, an embodiment of a ram tip in accordance with the invention is shown, generally designated 40. Ram tip 40 includes a base portion 41, and a pair of bilaterally disposed support walls 42*a* and 42*b* extending from base portion 41 which, in the depicted example, define lateral support portions over a length thereof, and which are arranged codirectionally with the extension axis A of a ram (not shown) to which it is mounted. The lateral support portions of support walls 42*a* and 42*b* are advantageously arranged approximately perpendicular to base portion 41 as shown. Base portion 41 includes a support surface 41*a* which is textured, with for example serrations, to inhibit lateral shifting of ram tip 40 with respect to work structure brought into contact therewith.

Ram tip 40, as depicted in the example of FIG. 4, is provided in the form of an adapter tip for mounted reception to a standard tip of a ram conveniently in a manner as described with regard to the prior art adapter tips. Therefore, it will be understood that the precise mode of mounting carried out in practice will depend upon the particular ram manufacturer and the specific structures employed in mounting other adapter tips. It is further noted that the manner in which mounting is accomplished, as well as the specific structures involved, are not critical to the invention. In the depicted example, which is directed to mounting to the ram arrangement of FIGS. 1 and 2, a pair of flanges 47 are provided, each with a mounting hole 43 for permitting reception therethrough of a locking pin (not shown) in analogous manner to the mounting method described with reference to FIG. 2. Reinforcement structure is provided for reducing the likelihood of angular deformation, conveniently in the form of a weld bead 45 in a position along at least a partial length of an intersecting locus of inwardly facing sides 44*a* and 44*b* of lateral support portions of support walls 42*a* and 42*b* and support surface 41*a* of base 41. Upper edges 46*a* and 46*b* are advantageously textured in the manner of support surface 41*a* to inhibit shifting relative structure brought into contact therewith, when so desired.

Figure 5:
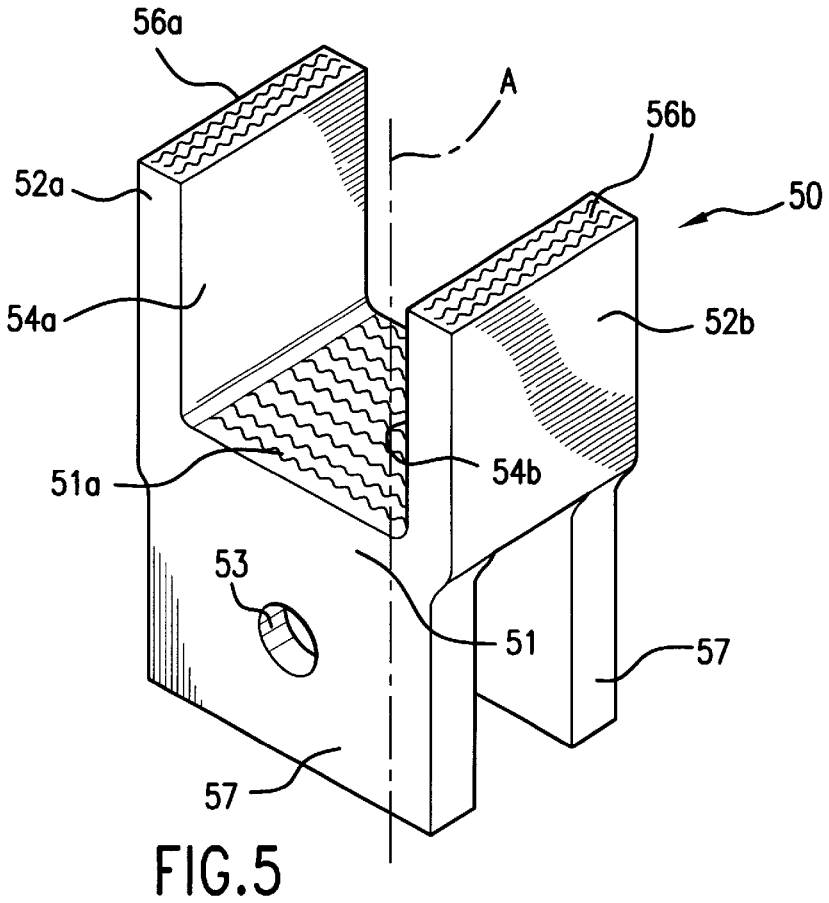
FIG. 5 is a perspective view of an alternative embodiment of an adapter tip in accordance with the invention.

Turning now to FIG. 5, another embodiment of a ram tip in accordance with the invention is depicted, also shown for purposes of illustration as an adapter, generally designated 50. In a manner analogous to the embodiment of FIG. 4, ram tip 50 includes a base portion 51 including a textured support surface 51*a*, a pair of bilaterally disposed support walls 52*a* and 52*b* extending from base portion 51 which define lateral support portions over a length thereof terminating in advantageously textured upper edges 56*a*, and which are arranged codirectionally with the extension axis A and advantageously arranged approximately perpendicular to base portion 51, and a pair of flanges 57, each with a mounting hole 53 formed therein. The embodiment of FIG. 5 differs from that described with reference to FIG. 4 in that flanges 51 are arranged in a position on base portion 51 perpendicular to that of support walls 52*a* and 52*b*, thereby substantially increasing the overall structural rigidity of base portion 51. It is noted that this approach is applicable to any of the embodiments directed to an adapter tip within the contemplated scope of the invention.

Figure 2:
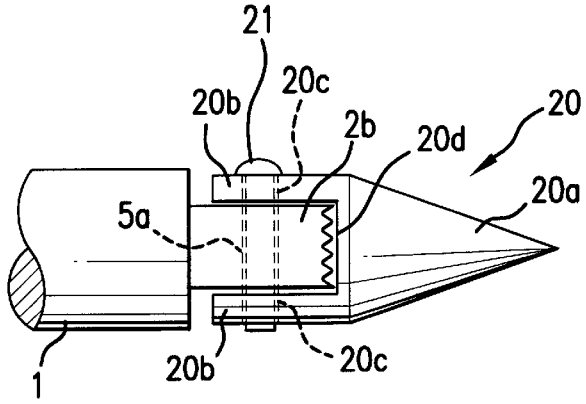
FIG.2 PRIOR ART
FIG. 2 is a partial plan view of a prior art conical point adapter tip mountably received over a standard tip of an extension ram.
Figure 6:
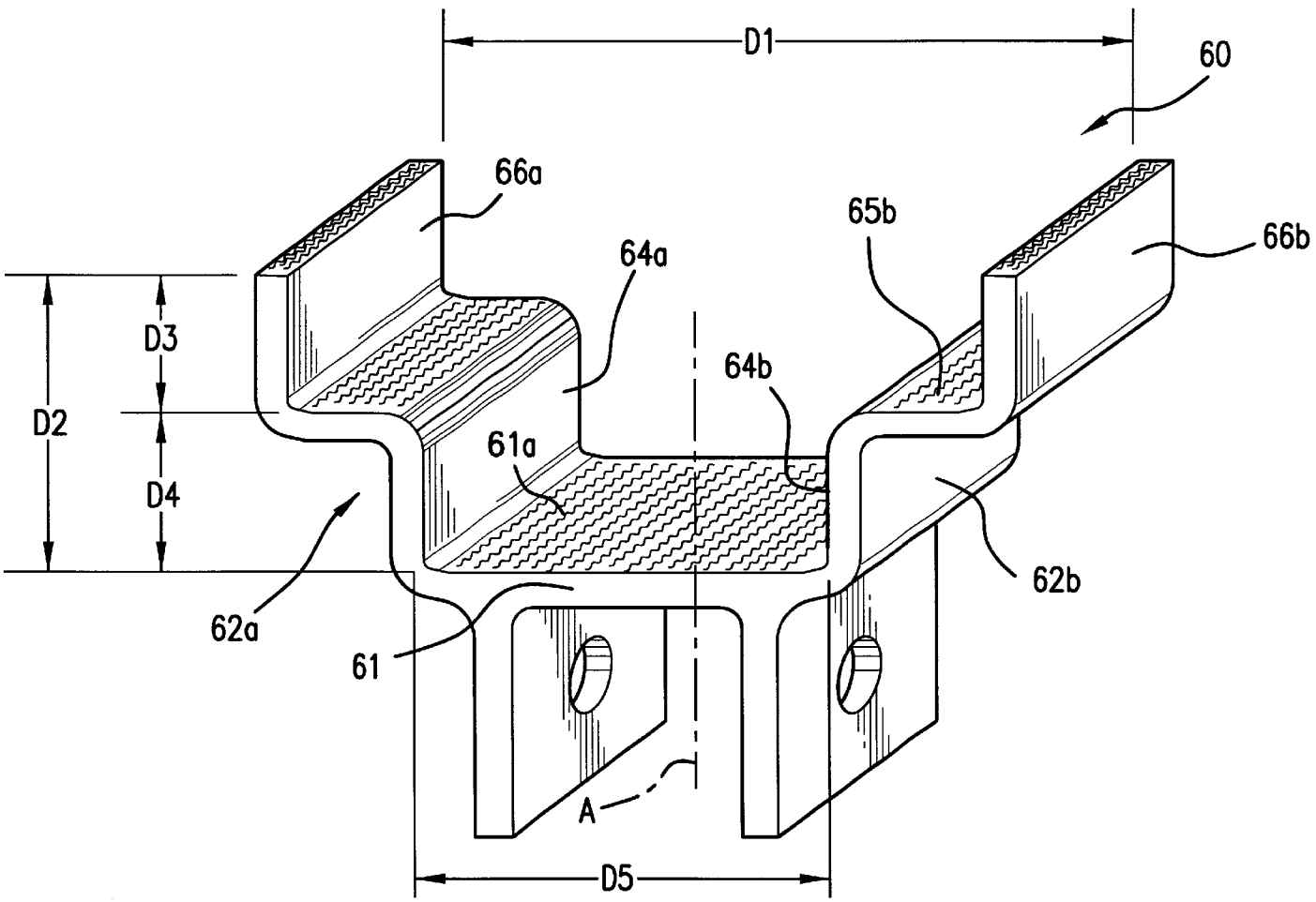
FIG. 6 is a perspective view of another embodiment of an adapter tip in accordance with the invention.

Referring now to FIG. 6, there is provided a ram tip of a design permitting fitted reception of work structure of two discrete widths, generally designated 60. As with the previously described embodiments, ram tip is depicted as a removable adapter mountable to a conventional ram design as shown in FIGS. 1 and 2. Variations applicable to the previous embodiments may be also employed in the embodiment of FIG. 6, within the scope of the invention as contemplated. Ram tip 60 includes a base portion 61 presenting an advantageously textured primary support surface 61, and a pair of bilaterally disposed support walls 62*a* and 62*b* extending from base portion 61. Support walls 62*a* and 62*b* include primary lateral support portions 64*a* and 64*b* extending from base portion 61 arranged codirectionally with extension axis A of the ram. An internally stepped region presents a pair of secondary support surfaces 65*a* and 65*b* parallel with primary support surface 61*a*, and a pair of secondary lateral support portions 66*a* and 66*b* extending codirectionally with ram extension axis A, and separated a greater distance from one another than primary lateral support portions 64*a* and 64*b*. Such configuration permits fitted reception of work structure of smaller width, such as a window frame, between primary lateral support portions 64*a* and 64*b* for support against primary support surface 61*a*, and fitted reception of structure of greater width, such as a "B" frame or steering column, between secondary lateral support portions 66*a* and 66*b* for support on either side thereof against secondary support surfaces 65*a* and 65*b*.

Figure 7:
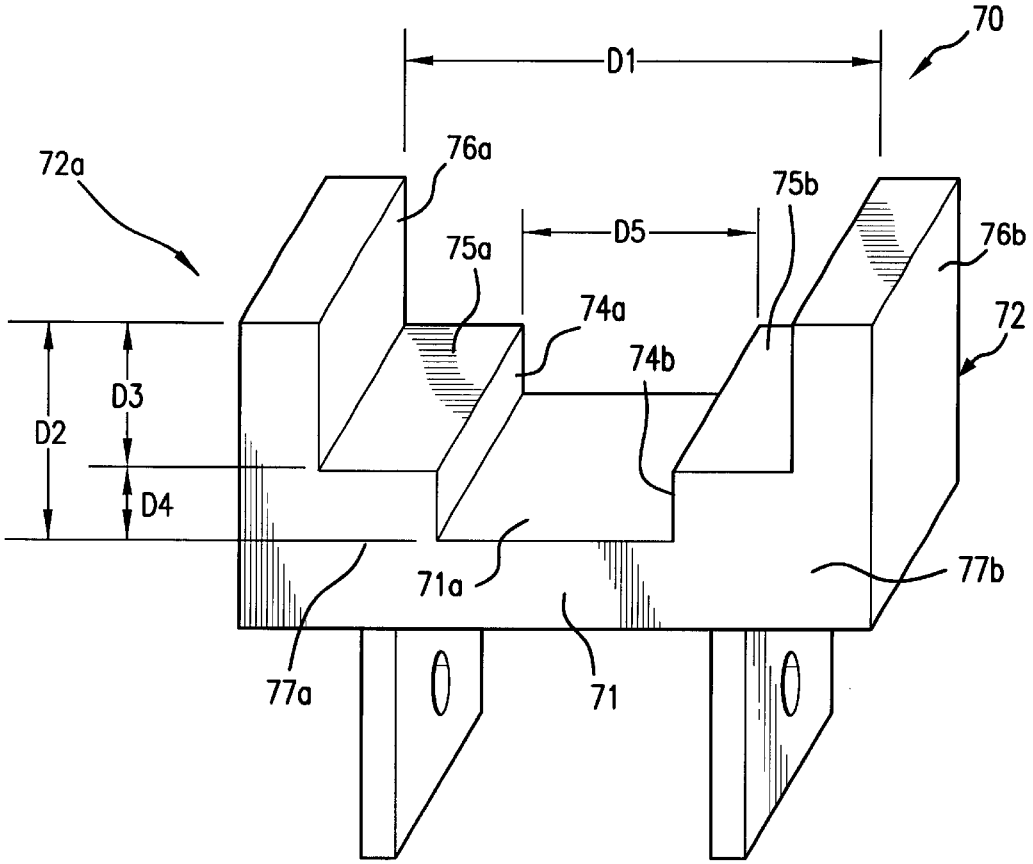
FIG. 7 is a perspective view of yet another embodiment of an adapter tip in accordance with the invention.

Turning now to FIG. 7, an adapter ram tip is shown at 70, and includes structure providing additional reinforcement for increased structural rigidity. The configuration of ram tip 70 is analogous with that of the embodiment described with reference to FIG. 6, and includes a base portion 71 presenting a primary support surface 71*a*, and a pair of bilaterally disposed support walls 72*a* and 72*b* extending from base portion 71. As in the aforementioned embodiment, support walls 72*a* and 72*b* present an internally stepped profile which includes primary lateral support portions 74*a* and 74*b* extending from base portion 71, a pair of secondary support surfaces 75*a* and 75*b* parallel with primary support surface 71*a*, and a pair of secondary lateral support portions 76*a* and 76*b* separated a greater distance from one another than primary lateral support portions 74*a* and 74*b*. Ram tip 70 differs from the embodiment of FIG. 6 in the addition of thickened regions 77*a* and 77*b* in the portion bounded by base portion 71 and primary lateral support portions 74*a* and 74*b*. Such configuration provides enhanced resistance against angular deflection of support walls 72*a* and 72*b* when extension force is applied.

Figure 8A:
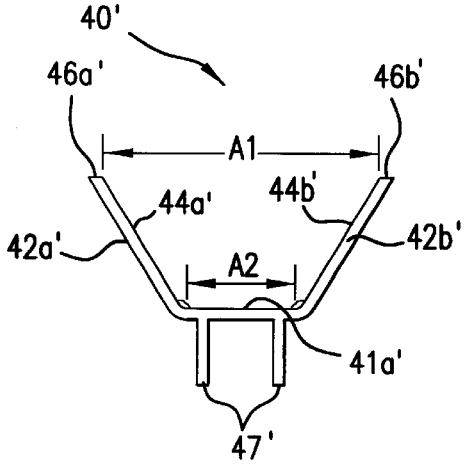
FIG. 8*a* is a front view of still another embodiment of an adapter tip in accordance with the invention.
Figure 8B:
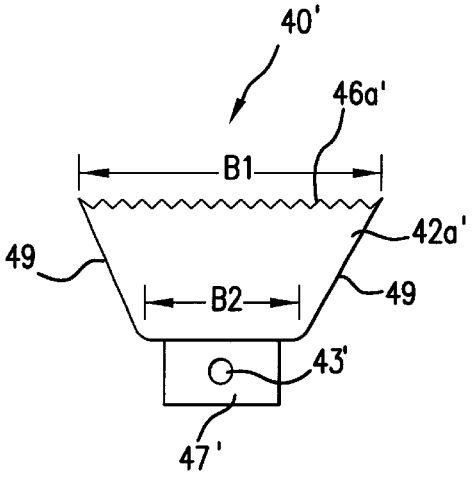
FIG. 8*b* is a side view of the embodiment of FIG. 8a rotated 90°.

In accordance with a particularly advantageous embodiment as depicted in FIGS. 8*a* and 8*b*, a ram tip 40' includes a tapered structure. For illustration purposes only, a design is depicted which is analogously configured with ram tip 40 of FIG. 4. However, it is to be understood that such tapered feature may be incorporated into a suitably designed ram tip according to any of the embodiments suggested herein or those contemplated within the intended scope of the invention as claimed. Ram tip 40' includes lateral support walls 42*a*' and 42*b*' presenting upper edges 46*a*' and 46*b*', a support surface 41*a*' and a pair of flanges 47'. The embodiment differs from that of FIG. 4 in that lateral support walls 42*a*' and 42*b*' are tapered from upper edges 46*a*' and 46*b*' to support surface 41*a*' with respect to inwardly facing surfaces 44*a*' and 44*b*' as shown in FIG. 8*a* and/or with respect to lateral sides 49 of lateral support walls 42*a*' and 42*b*' as shown in FIG. 8*b*. Such feature is advantageously space saving, eliminates unnecessary bulk and reduces material costs. Furthermore, such configuration enhances control during usage and reduces slippage by squeezing the contact surface as applied pressure is increased. A taper of about 1" from upper edges 46*a*' and 46*b*' to support surface 41*a*' is deemed advantageous for all four sides.

The ram tips in accordance with the various embodiments of the inventions may be constructed using conventional methods and materials currently employed for presently available ram tip designs.

Provided in the table below are preferred dimensions, given in inches, for embodiments of the present invention and are referenced in FIGS. 6 and 7. It is understood that the following dimensions are also applicable to the embodiments shown in FIGS. 4 and 5 as structure dictates. The dimensions are presented as preferred dimensions and are considered advantageous in use but are not limiting. It is noted that Example 3 includes only weld beads 45 in accordance with the general design guidelines as shown in FIG. 4, and therefore dimensions D3 and D4 are not applicable

| | D1 | D2 | D3 | D4 | D5 |
|---|---|---|---|---|---|
| EXAMPLE 1 | 4.75 | 3.5 | 2.5 | 1 | 1 |
| EXAMPLE 2 | 5 | 4 | 3 | 1 | 1.25 |
| EXAMPLE 3 | 3.25 | 2.5 | N/A | N/A | 2.25 |

The further table below lists preferred dimensions, given in inches, for embodiments of the present invention as shown in FIGS. 8*a* and 8*b* and are considered advantageous in use but are not limiting.

| | A1 | A2 | B1 | B2 |
|---|---|---|---|---|
| EXAMPLE 4 | 4.75 | 3.25 | 5 | 4 |
| EXAMPLE 5 | 3.75 | 2.25 | 4 | 3 |

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A ram tip for mounted use on a terminal end of a ram which is forcibly extendable along an extension axis thereof, the ram tip comprising:

a base portion presenting a primary support surface oriented substantially perpendicular to the extension axis and facing outwardly of the ram,; and a pair of supports carried on said base portion in spaced apart relationship from one another, said base portion and said supports together defining a reception channel running in a reception direction, an internal configuration of said reception channel presenting a pair of primary lateral support surfaces facing inwardly of said reception channel and arranged to extend codirectionally with the extension axis beyond said primary support surface, said internal configuration further defining secondary support surfaces laterally spaced apart from one another by a first separation distance, said secondary support surfaces being formed each on a respective one of the pair of supports, said secondary support surfaces lying on a common plane running crosswise to the extension axis and spaced apart from said primary support surface by a first extension distance, said internal configuration further defining a pair of secondary lateral support surfaces each facing inwardly of said reception channel and arranged to extend codirectionally with the extension axis beyond said secondary support surfaces by a second extension distance, each of said secondary lateral support surfaces being disposed laterally outward of a respective one of said primary lateral support surfaces and spaced apart from one another by a second separation distance, whereby a form of structural material presenting a first width less than said first separation distance is accommodated between said secondary support surfaces and said primary lateral support surfaces and is supported on said primary support surface, and another form of the structural material presenting a second width larger than the first separation distance and no larger than the second separation distance is accommodated between the secondary lateral support surfaces and is bilaterally supported on said secondary support surfaces, said primary support surface and said secondary support surfaces each presenting gripping structure for at least partially penetrating the structural material brought into contact therewith when said ram is forcibly extended, said gripping structure being suitably configured to provide resistance against lateral movement of the ram tip relative to the structural material in pressurized contact therewith at least in said reception direction.

2. A ram tip according to claim 1, wherein said ram tip is carried in a permanent position on the ram.

3. A ram tip according to claim 1, wherein said ram tip is mountably receivable on the ram as a removable adapter tip.

4. A ram tip according to claim 3, further comprising a pair of mounting flanges extending from said base crosswise to said primary support surface in a direction opposite said supports, said mounting flanges including mounting structure for permitting engagement thereof with cooperative mounting structure carried on a standard tip of the ram.

5. A ram tip according to claim 4, wherein said pair of mounting flanges defines a mounting channel therebetween running in a mounting direction, said mounting direction being arranged orthogonal to said reception direction, said pair of mounting flanges thereby providing reinforcement against deformation of said base portion when working pressure is applied.

6. A ram tip according to claim 1, wherein said primary lateral support surfaces are approximately parallel with the extension axis.

7. A ram tip according to claim 1, wherein:

said supports include terminal ends presenting end surfaces thereof which lie on a common plane running crosswise to the extension axis; and said end surfaces presenting auxiliary gripping structure for at least partially penetrating structural material brought into contact therewith when said ram is forcibly extended, said auxiliary gripping structure being suitably configured to provide resistance against lateral movement of the ram tip relative to the structural material in pressurized contact therewith, said supports possessing sufficient strength to resist significant deformation when at least a portion of at least one of said end surfaces is brought into pressurized contact with said structural material.

8. A ram tip according to claim 1, wherein said supports include reinforcement structure provided along at least a partial length of a locus of any two surface planes which intersect at angles with one another.

9. A ram tip according to claim 8, wherein said reinforcement structure includes a weld bead.

10. A ram tip according to claim 1, wherein said supports include terminal ends, a width of each of said supports tapering in a direction from said terminal ends to said base portion.

11. A ram tip according to claim 10, wherein:

a width dimension of each of said supports at said terminal ends is in a range of about 4 inches to about 5 inches; and another width dimension of each of said supports at said base portion is in a range of about 3 to about 4 inches.

12. A ram tip according to claim 1, wherein:

said first separation distance is in a range of about 1 inch to about 2.25 inches; and said second separation distance is in a range of about 3.25 inches to about 5 inches.

13. A ram tip according to claim 1, wherein:

said first extension distance is about 1 inch; and and said second extension distance is in a range of about 2.5 inches to about 3 inches.

14. A ram tip according to claim 1, wherein said primary support surface and said secondary surfaces lie generally on two respective planes substantially parallel with one another.

15. A ram tip for mounted use at a terminal end of a ram which is forcibly extendable along an extension axis thereof, the ram tip comprising:

a base portion presenting a primary support surface oriented substantially perpendicular to the extension axis and facing outwardly of the ram;

a pair of bilaterally disposed support walls extending from said base portion;

said support walls including a pair of primary lateral support portions arranged codirectionally with the extension axis; and said support walls further including an internally stepped region at an end of each of said primary lateral support portions distant from said primary support surface presenting a pair of secondary support surfaces lying on a common plane running crosswise to the extension axis, and further including a pair of secondary lateral support portions extending codirectionally with the extension axis of the ram, said pair of secondary lateral support portions being separated a greater distance from one another than said pair of primary lateral support portions, said support walls defining a reception channel running in a reception direction, said primary support surface and said pair of secondary support surfaces each presenting gripping structure for at least partially penetrating structural material brought into contact therewith when said ram is forcibly extended, said gripping structure being suitably configured to provide resistance against lateral movement of the ram tip relative to the structural material in pressurized contact therewith at least in said reception direction.

16. A ram tip according to claim 15, wherein said support walls include terminal ends presenting end surfaces which lie on a plane running crosswise to the extension axis.

17. A ram tip according to claim 15, wherein a width of each of said pair of secondary support surfaces which extend between corresponding planes of each of said primary lateral support portions and said secondary lateral support portions are approximately equal.

18. A ram tip according to claim 15, wherein said support walls include reinforcement structure for providing enhanced resistance against angular deformation during application of ram extension force, said reinforcement structure including thickened regions in a region of said support walls bounded by said base portion and said primary lateral support portions.

19. A ram tip according to claim 15, wherein said support walls include terminal ends presenting a pair of end surfaces which lie on a common plane crosswise to the extension axis.

20. A ram tip according to claim 15, further comprising a pair of mounting flanges extending from said base approximately perpendicular to said primary support surface in a direction opposite said support flanges, said mounting flanges including mounting structure for permitting engagement thereof with cooperative mounting structure carried on a standard tip of the ram.

21. A ram tip according to claim 20, wherein said pair of mounting flanges defines a mounting channel therebetween running in a mounting direction, said mounting direction being arranged orthogonal to said reception direction, said pair of mounting flanges thereby providing reinforcement against deformation of said base portion when working pressure is applied.

22. A ram tip mountable as an adapter on a ram forcibly extendable along an extension axis thereof, the ram tip being receivable at a terminal end of the ram, the ram tip comprising:

a base portion presenting a primary support surface oriented crosswise to the extension axis and facing outwardly of the ram;

a pair of bilaterally disposed support walls extending from said base;

said support walls including a pair of primary lateral support portions arranged codirectionally with the extension axis;

said support walls further including an internally stepped region at an end of each of said primary lateral support portions distant from said primary support surface presenting a pair of secondary support surfaces lying on a common plane crosswise to the extension axis, and further including a pair of secondary lateral support portions extending codirectionally with the extension axis of the ram, said pair of secondary lateral support portions being separated a greater distance from one another than said pair of primary lateral support portions;

means for mounting said ram tip to said ram including a pair of mounting flanges extending from said base approximately perpendicular to said primary support surface in a direction opposite said support flanges, said mounting flanges including mounting structure for permitting engagement thereof with cooperative mounting structure carried on a standard tip of the ram;

said support walls include terminal ends presenting a pair of end surfaces which lie on a common plane approximately parallel with said primary support surface; and said support walls defining a reception channel running in a reception direction, said primary support surface and said pair of secondary support surfaces each presenting gripping structure for at least partially penetrating structural material brought into contact therewith when said ram is forcibly extended, said gripping structure being suitably configured to provide resistance against lateral movement of the ram tip relative to the structural material in pressurized contact therewith at least in said reception direction.

23. A ram tip according to claim 22, wherein said pair of mounting flanges defines a mounting channel therebetween running in a mounting direction, said mounting direction being arranged orthogonal to said reception direction, said pair of mounting flanges thereby providing reinforcement against deformation of said base portion when working pressure is applied.

* * * * *